US011084149B2

(12) United States Patent
Wu

(10) Patent No.: US 11,084,149 B2
(45) Date of Patent: Aug. 10, 2021

(54) SOCKET TOOL

(71) Applicant: Panda Tool Co., Ltd., Taichung (TW)

(72) Inventor: Ting-Ysai Wu, Taichung (TW)

(73) Assignee: Panda Tool Co., Ltd., Taichung (TW)

( * ) Notice: Subject to any disclaimer, the term of this patent is extended or adjusted under 35 U.S.C. 154(b) by 0 days.

(21) Appl. No.: 16/373,805

(22) Filed: Apr. 3, 2019

(65) Prior Publication Data

US 2020/0198102 A1 Jun. 25, 2020

(30) Foreign Application Priority Data

Dec. 20, 2018 (TW) ..... 107146022

(51) Int. Cl.
*B25B 23/00* (2006.01)
*B25B 13/06* (2006.01)

(52) U.S. Cl.
CPC ..... *B25B 23/0035* (2013.01); *B25B 13/065* (2013.01); *B25B 13/06* (2013.01)

(58) Field of Classification Search
CPC .... B25B 23/0035; B25B 13/065; B25B 13/06
See application file for complete search history.

(56) References Cited

U.S. PATENT DOCUMENTS 2,704,681 A * 3/1955 Fischer ..... F16B 21/186 403/326
4,993,289 A * 2/1991 Parks ..... B25B 13/06 81/121.1
5,485,769 A * 1/1996 Olson ..... B25B 15/001 81/177.85
6,076,436 A * 6/2000 Farley ..... B25B 23/0035 403/324

(Continued)

FOREIGN PATENT DOCUMENTS

KR 20140001563 U 3/2014
TW 200927391 A 7/2009
TW I388403 B 3/2013

*Primary Examiner* — Eric A. Gates
*Assistant Examiner* — Paul M Janeski

(74) *Attorney, Agent, or Firm* — Alan D. Kamrath; Karin L. Williams; Mayer & Williams PC

(57) ABSTRACT

The present disclosure provides a socket tool which is used to be connected to a driving head of a tool, and the socket tool is especially suitable for a driving head which is equipped with a friction ring. The socket tool includes a connecting portion and a working portion. The connecting portion which is located on one side of the socket tool includes a top surface and a polygonal hole. The top surface is recessed along an axis of the socket tool to form an indentation which can accommodate the friction ring of the driving head. The polygonal hole which can accommodate the driving head penetrates the indentation along the axis of the socket tool. The working portion which is located on the other side of the socket tool has, for example, a hexagonal hole that can be used to cover a bolt or a nut. The indentation can accommodate the friction ring of the driving head, so that an abutting surface of the driving head can contact the top surface of the socket tool directly. Therefore, a user can align the polygonal hole to the driving head easily and directly, making the socket tool of the present invention convenient, fast, and safe in use.

10 Claims, 11 Drawing Sheets

(56) References Cited

U.S. PATENT DOCUMENTS

2006/0175773 A1 8/2006 Tsai et al.
2008/0087448 A1* 4/2008 Happ ..... B25B 23/0035
173/93

* cited by examiner

SOCKET TOOL

RELATED APPLICATIONS

This application claims priority to Taiwan Application Serial Number 107146022, filed on Dec. 20, 2018, which is herein incorporated by reference.

FIELD OF THE INVENTION

The present disclosure relates to a socket tool, which can be connected to a driving head of a tool.

BACKGROUND OF THE INVENTION

A socket tool can be connected to a driving head of a tool for tightening or loosening a bolt or a nut. As shown in FIG. 1 to FIG. 3, a conventional socket tool includes a connecting portion 70 and a working portion 80. The working portion 80 has a hexagonal hole 81. The connecting portion 70 has a top surface 71 and a square hole 72. The driving heads are usually formed as a square prism, and the square hole 72 of the socket tool can be mated to the driving head. The driving head of a tool, such as an impact wrench, is usually equipped with a friction ring, such as a C-ring, to increases the tightness between the square hole 72 of the socket tool and the driving head. Therefore, the socket tool can be prevented from accidentally falling off the driving head.

The conventional socket tool has problems with alignment when a user tries to connect the conventional socket tool to a driving head which is equipped with a friction ring. First, the friction ring which protrudes from the side of the driving head abuts against the top surface 71, and the friction ring is sandwiched between the driving head and the top surface 71. Therefore, the driving head cannot directly contact the top surface 71, and thus the driving head cannot be directly aligned with the square hole 72. Second, during alignment, the user can only rely on visual observation which needs well-lighted environment, so the alignment may not be correct. Third, if the alignment is incorrect, the driving head will abut against the top surface 71 during connection process, and the tightness between the friction ring and the socket tool makes the driving head hard to be aligned correctly by rotation. Furthermore, the driving head may be tilted and jammed in the square hole 72 accidentally, and the driving head is hard be pulled out from the square hole 72 for realignment. Fourth, the user may trigger the power tool in order to rotate the driving head to facilitate the alignment, but the high-speed rotation of the driving head may accidentally cause the high-speed rotation of the socket tool. Hence, the user's hand may be injured. Therefore, the whole connection process may be time-consuming, inconvenient, and insecure.

The present invention is, therefore, arisen to obviate or at least mitigate the above mentioned disadvantages.

SUMMARY OF THE INVENTION

One of the objects of the present invention is to provide a socket tool which can make the driving head directly aligned with the square hole, and the alignment can be completed easily even in a dim or narrow workplace.

To achieve the above and other objects, the present invention provides a socket tool which is used to be connected to a driving head of a tool, and the socket tool is especially suitable for a driving head which is equipped with a friction ring. The socket tool of the present invention includes a connecting portion and a working portion. The connecting portion which is located on one side of the socket tool includes a top surface and a polygonal hole. The top surface is recessed along an axis of the socket tool to form an indentation which can accommodate the friction ring of the driving head. The polygonal hole which can accommodate the driving head penetrates the indentation along the axis of the socket tool. The working portion is located on the other side of the socket tool.

In some embodiments, an indentation length along the axis of the socket tool is longer than a thickness of the friction ring along the axis of the socket tool.

In some embodiments, viewed along the direction of the axis of the socket tool, the indentation has a periphery which is interrupted by the polygonal hole.

In some embodiments, the periphery is substantially circular, and a periphery diameter is larger than an outer diameter of the friction ring.

In some embodiments, the periphery is smaller than a first circumscribed circle of the polygonal hole but larger than a first inscribed circle of the polygonal hole.

In some embodiments, the periphery is substantially polygonal, and a diameter of a second inscribed circle of the periphery is larger than the outer diameter of the friction ring.

In some embodiments, a second circumscribed circle of the periphery is smaller than the first circumscribed circle of the polygonal hole but larger than the first inscribed circle of the polygonal hole.

In some embodiments, the indentation has a side surface and a bottom surface, the side surface is parallel or inclined to the axis of the socket tool, and the bottom surface is a plane, an arcuate surface, or a tapered surface.

In some embodiments, the polygonal hole is a square hole, and the working portion has a hexagonal hole which extends toward the top surface along the axis of the socket tool.

In some embodiments, the connecting portion has at least one lateral hole which is perpendicular to the axis of the socket tool, and the lateral hole communicates with the polygonal hole.

The present invention will become more obvious from the following description when taken in connection with the accompanying drawings, which show, for purpose of illustrations only, the preferred embodiment(s) in accordance with the present invention.

BRIEF DESCRIPTION OF THE DRAWINGS

The present disclosure can be more fully understood by reading the following detailed description of the embodiment, with reference made to the accompanying drawings as follows.

DETAILED DESCRIPTION OF THE PREFERRED EMBODIMENTS

The present invention provides a socket tool which is used to be connected to a driving head of a tool, and the socket tool is especially suitable for a driving head which is equipped with a friction ring. Please refer to FIG. 4 to FIG. 7, the present embodiment reveals a socket tool that includes a connecting portion 10, a working portion 20, and a middle hole 30. The connecting portion 10 and the working portion 20 are located on two opposite sides of the socket tool respectively.

Figure 1:
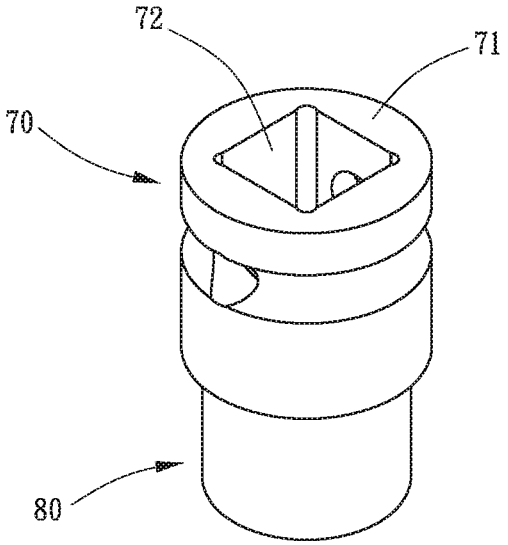
FIG. 1 is a stereogram showing a conventional socket tool.
Figure 2:
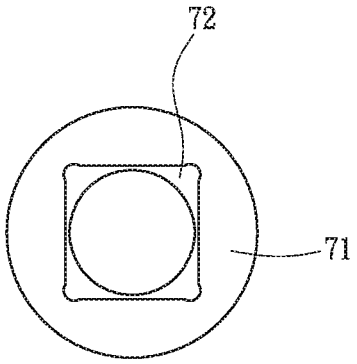
FIG. 2 is a top view showing a conventional socket tool.
Figure 3:
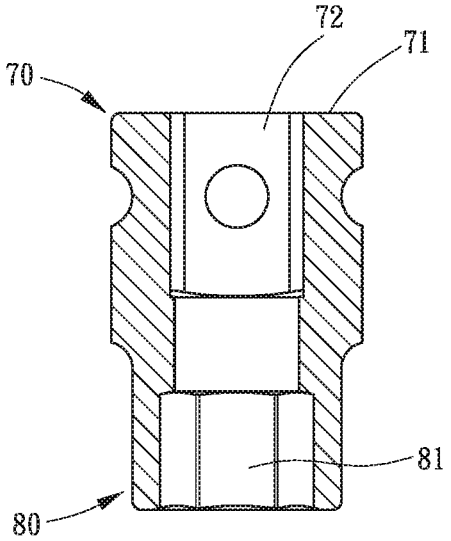
FIG. 3 is a section view showing a conventional socket tool.
Figure 4:
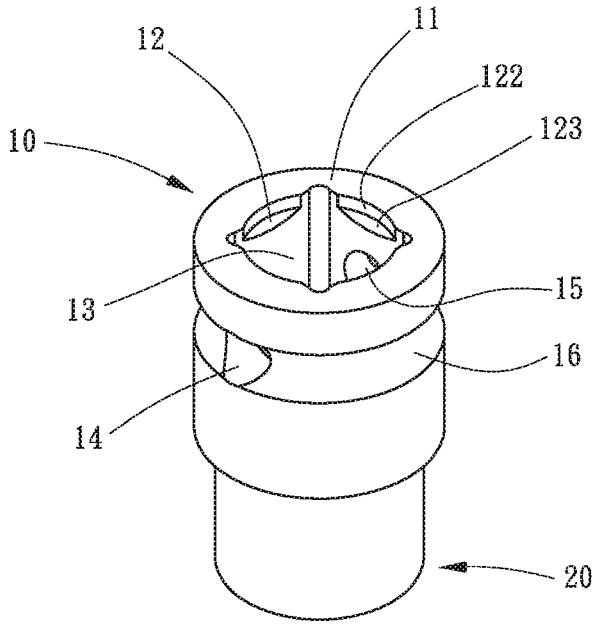
FIG. 4 is a stereogram showing a first embodiment of the present invention.
Figure 5:
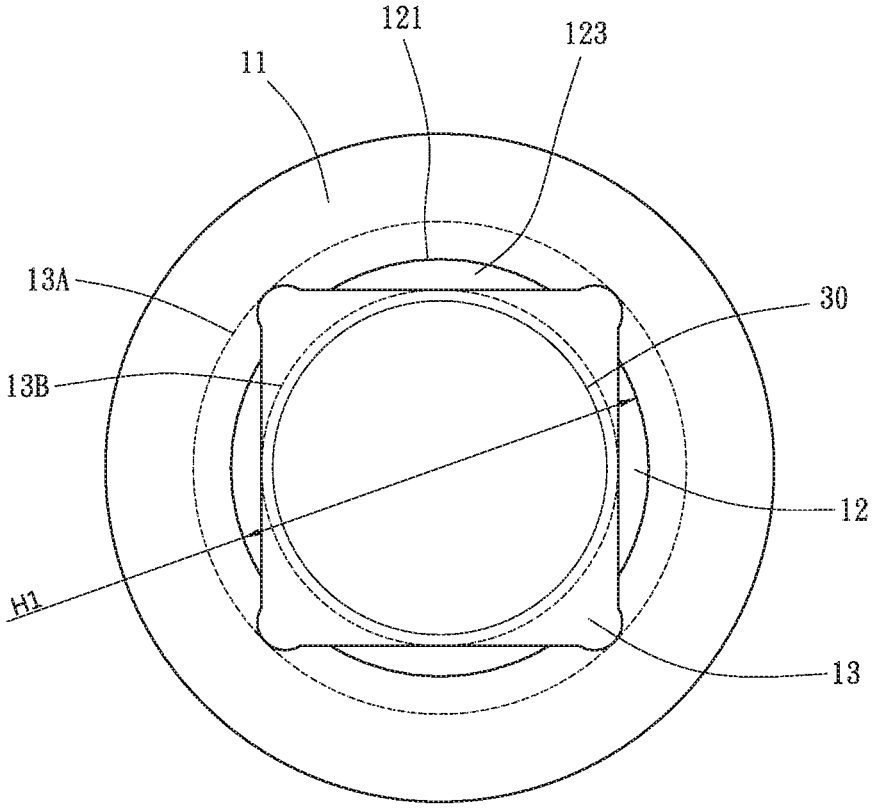
FIG. 5 is a top view showing a first embodiment of the present invention.

The connecting portion 10 has a top surface 11. The top surface 11 is recessed along an axis X of the socket tool to form an indentation 12 which can accommodate the friction ring of the driving head. The connecting portion 10 further has a square hole 13. The square hole 13 which can accommodate the driving head penetrates the indentation 12 along the axis X of the socket tool. Viewed along the direction of the axis X of the socket tool, as shown in FIG. 5, the indentation 12 has a periphery 121. The periphery 121 is interrupted by the square hole 13. The periphery 121 is substantially circular, and the periphery diameter H1 is larger than the outer diameter of the friction ring. Furthermore, the periphery 121 is smaller than a first circumscribed circle 13A of the square hole 13 but larger than a first inscribed circle 13B of the square hole 13. The indentation 12 has a side surface 122 and a bottom surface 123. The side surface 122 is parallel to the axis X of the socket tool, and the bottom surface 123 is a tapered surface. The periphery 121 is the contour of the side surface 122 when the side surface 122 is viewed along the direction of the axis X.

Furthermore, the connecting portion 10 has two lateral holes 14, 15 and an annular concave 16. Two lateral holes 14, 15 are perpendicular to the axis X. Two lateral holes 14, 15 communicate with the square hole 13, and two lateral holes 14, 15 are coaxial. The annular concave 16 is located on the outer diameter surface of the connecting portion 10, and the annular concave 16 is connected to the lateral holes 14, 15.

The working portion 20 has a working surface 21. The working surface 21 has a hexagonal hole 22 which extends toward the top surface 11 along the axis X. The hexagonal hole 22 can be used to cover a bolt or a nut.

The middle hole 30 has a cylindrical shape, and the diameter of the middle hole 30 is smaller than the diameter of the first inscribed circle 13B of the square hole 13. The middle hole 30 is located between the square hole 13 and the hexagonal hole 22, so that the square hole 13 and the hexagonal hole 22 communicate with each other through the middle hole 30. In other possible embodiments of the present invention, the diameter of the middle hole may be equal to or larger than the diameter of the first inscribed circle of the square hole. Furthermore, the socket tool may not have the middle hole.

Figure 6:
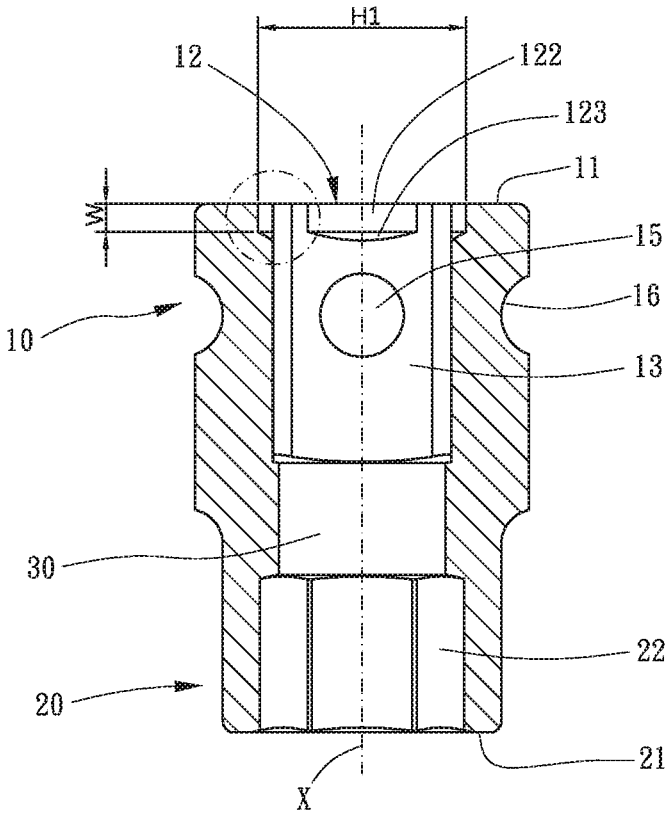
FIG. 6 is a section view showing a first embodiment of the present invention.
Figure 7:
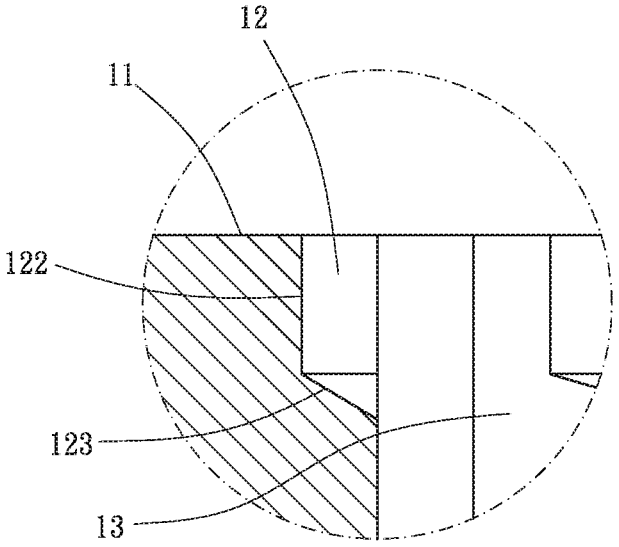
FIG. 7 is a partial enlargement of FIG. 6.
Figure 8:
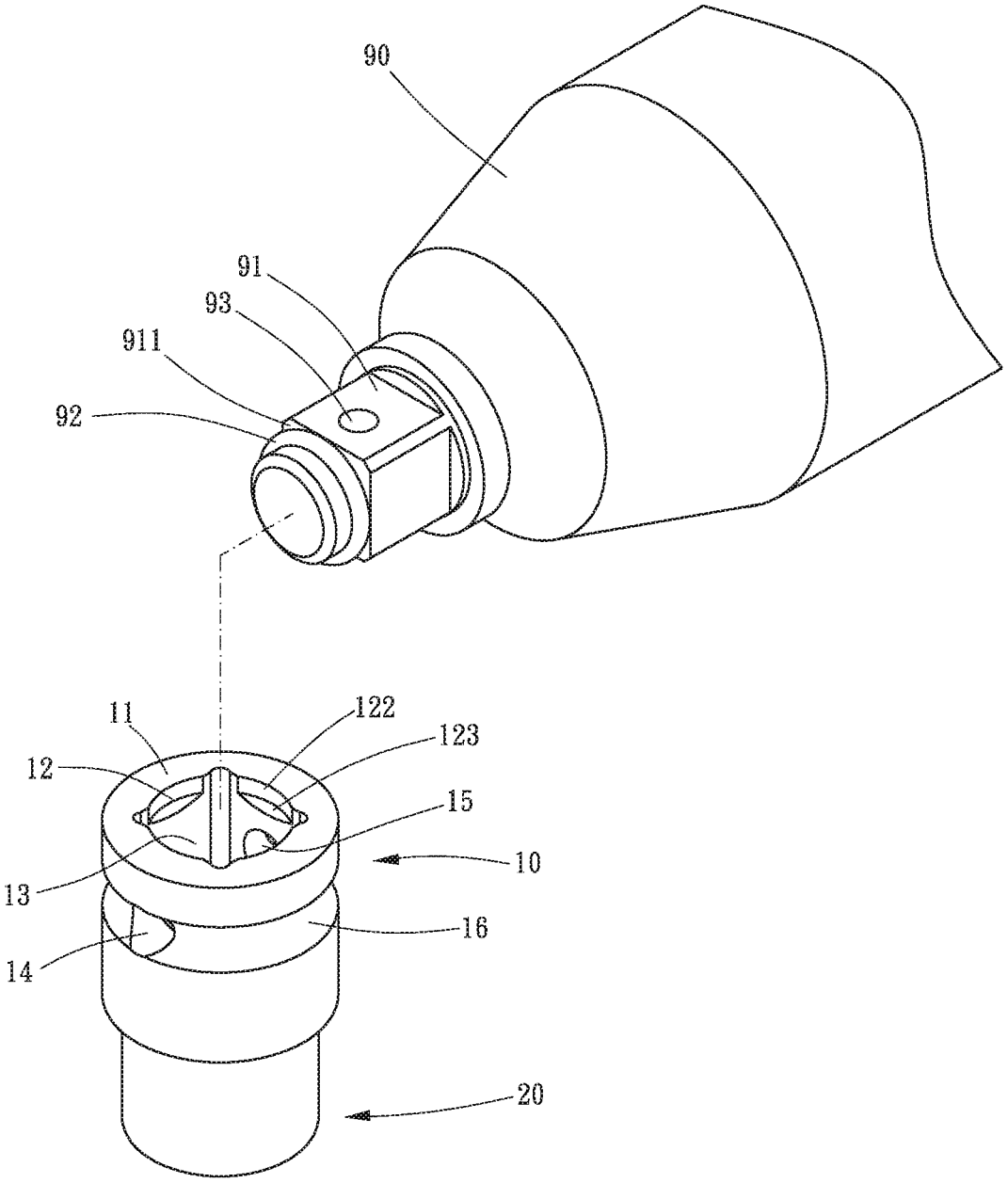
FIG. 8 is a schematic view showing a first embodiment of the present invention and a driving head which is equipped with a friction ring.
Figure 9:
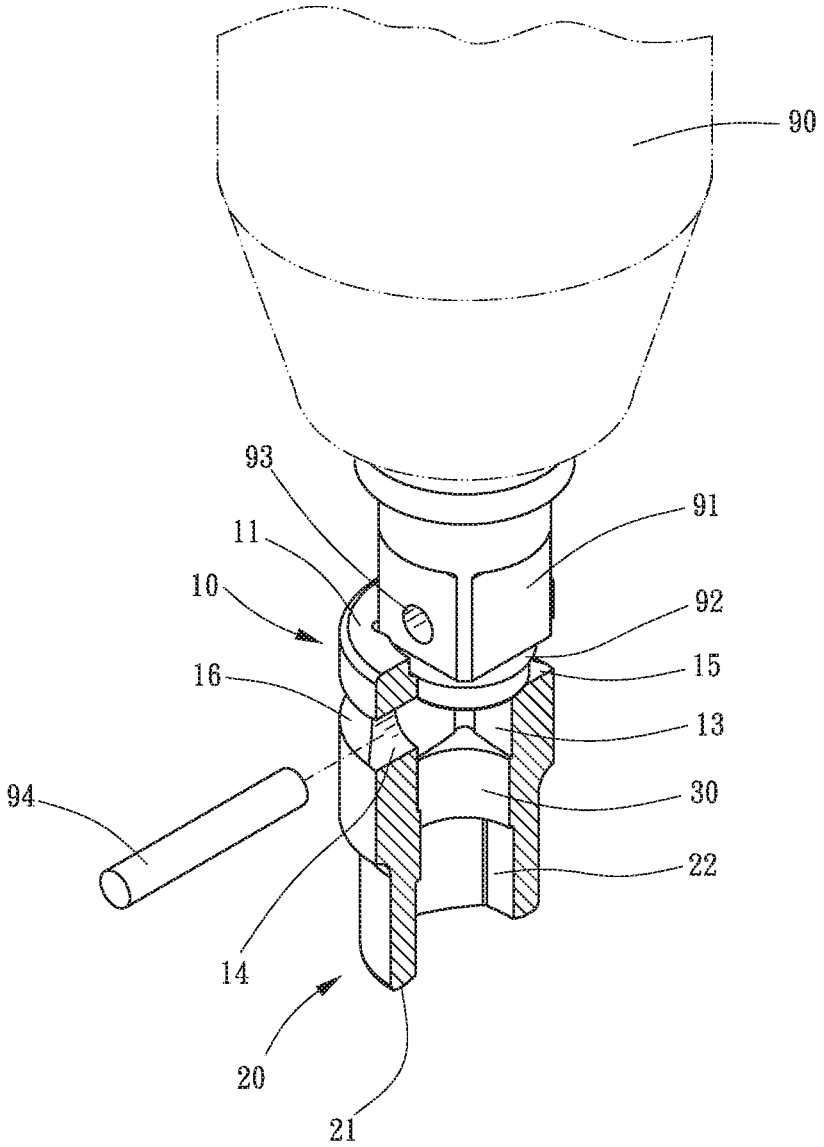
FIG. 9 is a schematic view showing a first embodiment of the present invention accommodates a friction ring of the driving head.
Figure 10:
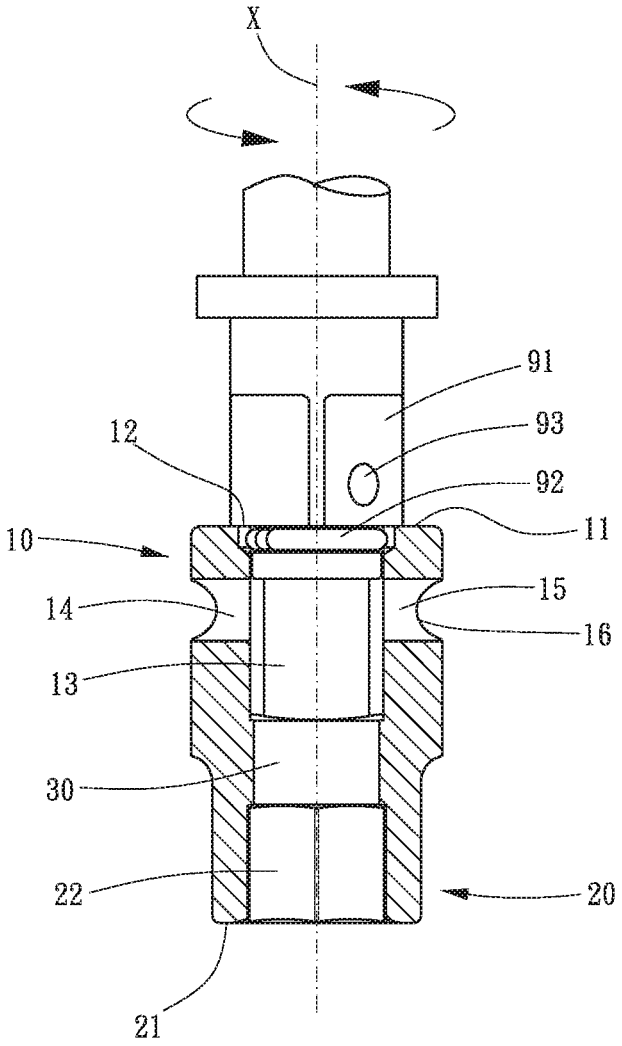
FIG. 10 to FIG. 12 is schematic drawings showing the connection process of a first embodiment and a driving head.
Figure 11:
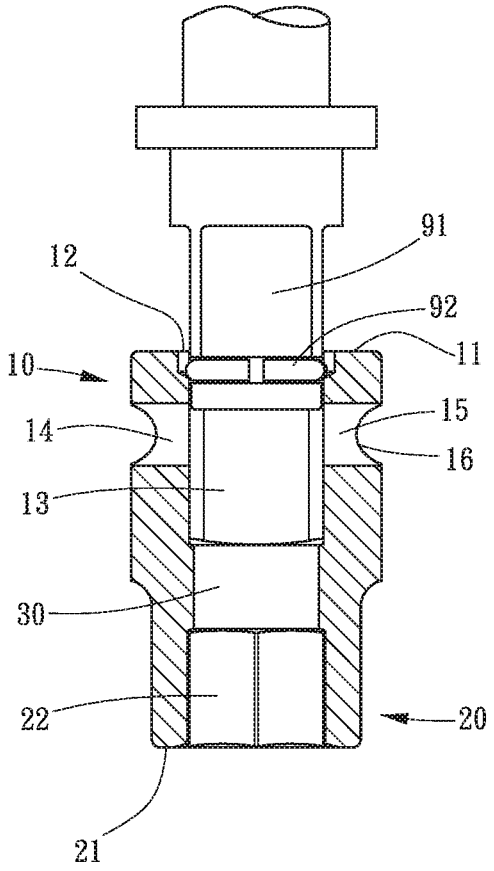
Figure 12:
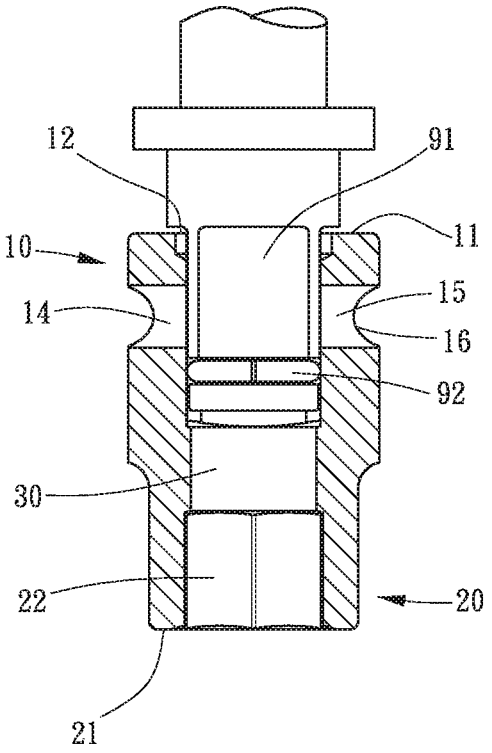

Please refer to FIG. 8 to FIG. 12, showing the detailed description of the connection process of the socket tool and the driving head 91 of an impact wrench 90. The impact wrench 90 has the square driving head 91 which has an abutting surface 911, a C-ring 92, and a locking hole 93. The periphery diameter H1 is larger than the outer diameter of the C-ring 92. Furthermore, the indentation length W along the axis X, as shown in FIG. 6, is larger than the thickness of the C-ring 92 along the axis X. Therefore, the indentation 12 can accommodate the C-ring 92. When the indentation 12 accommodates the C-ring 92, the abutting surface 911 of the driving head 91 can contact against the top surface 11 directly, as shown in FIG. 10. Then, the socket tool can be easily rotated to align the square hole 13 to the driving head 91, and the driving head 91 can easily enter the square hole 13 when aligned correctly, as shown in FIG. 11. However, since the outer diameter of the C-ring 92 is larger than the diameter of the first inscribed circle 13B of the square hole 13, the C-ring 92 is stopped at the bottom surface 123 of the indentation 12, as shown in FIG. 11, resulting in the driving head 91 cannot continue to be inserted. At this time, a force is applied along the axis X to deform the C-ring 92 in order to reduce the outer diameter of the C-ring 92, and then the driving head 91 together with the C-ring 92 can continue to be inserted into the socket tool along the square hole 13. After the driving head 91 and the socket tool are completely connected, the locking hole 93 of the driving head 91 communicates with the lateral holes 14, 15. A locking pin 94 can pass through the lateral holes 14, 15 and the locking hole 93 to fix the socket tool to the driving head 91 in order to avoid displacement and slippage.

It should be noted that, because the bottom surface 123 is a tapered surface, the bottom surface 123 is formed with a relatively narrow space at the bottom of the indentation 12. When the C-ring 92 is accommodated in the indentation 12, a part of the C-ring 92 may be accommodated in the space. However, the space is too narrow when compared to the indentation 12, so the space is ignored. Therefore, the indentation length W mentioned above, as shown in FIG. 6, refers to the shortest distance from the top surface 11 to the bottom surface 123. In other words, the indentation length W refers to the length of the side surface 122 along the axis X, and the error that may be caused by the space of the bottom surface 123 is ignored.

Figure 13:
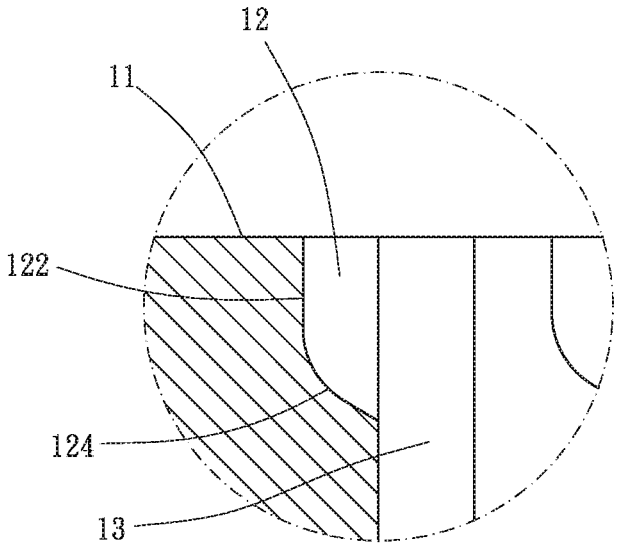
FIG. 13 is a partially enlarged section view showing a second embodiment of the present invention.

Please refer to FIG. 13. The socket tool of a second embodiment of the present invention is substantially the same as the first embodiment shown in FIG. 4 to FIG. 12, except that the bottom surface 124 is an arcuate surface. The second embodiment basically adopts the component symbols of the first embodiment. In other possible embodiments of the present invention, the bottom surface may be a plane that is perpendicular to the axis X.

Figure 14:
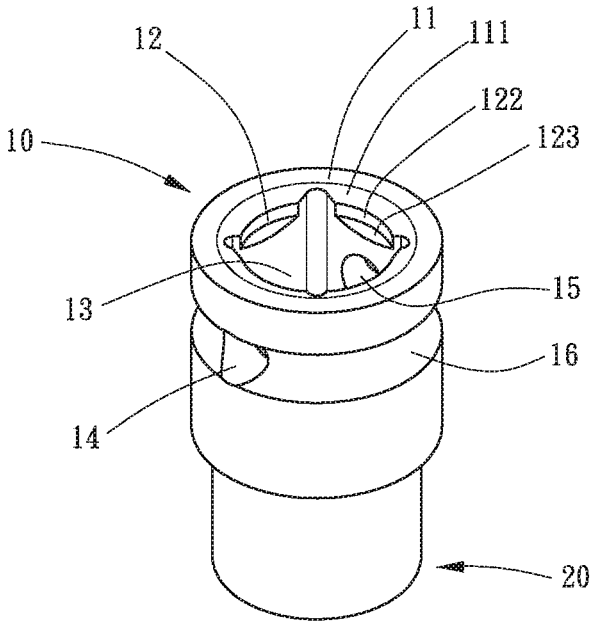
FIG. 14 is a stereogram showing a third embodiment of the present invention.
Figure 15:
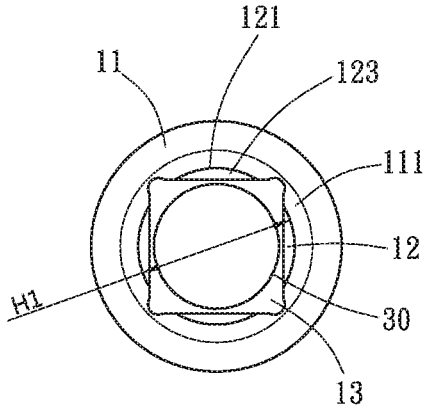
FIG. 15 is a top view showing a third embodiment of the present invention.
Figure 16:
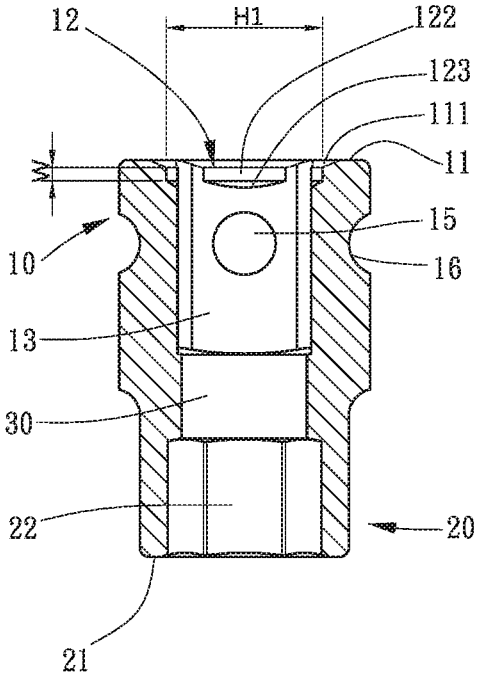
FIG. 16 is a section view showing a third embodiment of the present invention.

Please refer to FIG. 14 to FIG. 16. The socket tool of a third embodiment of the present invention is substantially the same as the first embodiment shown in FIG. 4 to FIG. 12, except that the top surface 11 further has an inner inclined surface 111. The third embodiment basically adopts the component symbols of the first embodiment. The inner inclined surface 111 is recessed toward the working portion to form a tapered surface, and the inner inclined surface 111 is concentric with the periphery 121. The outer diameter of the inner inclined surface 111 is larger than the diameter of the first circumscribed circle 13A of the square hole 13. A user can easily slide the C-ring 92 along the inner inclined surface 111 into the indentation 12. In other possible embodiments of the present invention, the outer diameter of the inner inclined surface 111 may be equal to or smaller than the diameter of the first circumscribed circle 13A of the square hole 13.

It should be noted that, because the bottom surface 123 is a tapered surface, the bottom surface 123 is formed with a relatively narrow space at the bottom of the indentation 12. When the C-ring 92 is accommodated in the indentation 12, a part of the C-ring 92 may be accommodated in the space. However, the space is too narrow when compared to the indentation 12, so the space is ignored. Therefore, the indentation length W of the third embodiment, as shown in FIG. 16, refers to the shortest distance from the inner inclined surface 111 to the bottom surface 123. In other words, the indentation length W refers to the length of the side surface 122 along the axis X, and the error that may be caused by the space of the bottom surface 123 is ignored.

Figure 17:
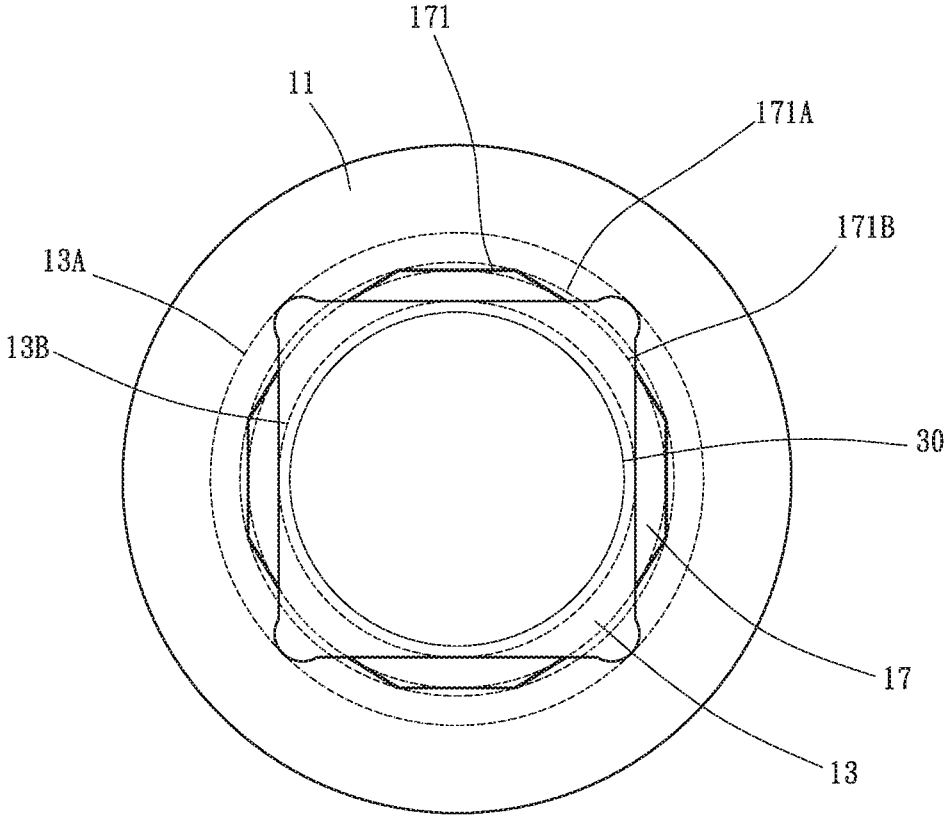
FIG. 17 is a top view showing a fourth embodiment of the present invention.

Please refer to FIG. 17. The socket tool of a fourth embodiment of the present invention is substantially the same as the first embodiment shown in FIG. 4 to FIG. 12, except that the indentation 17 has a different shape. The fourth embodiment basically adopts the component symbols of the first embodiment. The periphery 171 of the indentation 17 is substantially polygonal, and the diameter of a second inscribed circle 171B of the periphery 171 is larger than the outer diameter of the C-ring 92. Furthermore, a second circumscribed circle 171A of the periphery 171 is smaller than the first circumscribed circle 13A of the square hole 13 but larger than the first inscribed circle 13B of the square hole 13.

In the above embodiments, the square hole 13 can accommodate the driving head. In other possible embodiments of the present invention, the square hole may be formed as a polygonal hole other than a square hole in order to be mated with driving heads or tools which may be formed with polygonal poles.

In the above embodiments, the side surface is parallel to the axis X of the socket tool. In other possible embodiments of the present invention, the side surface may be inclined to the axis X. As long as the indentation can accommodate the C-ring, the present invention is not limited thereto.

In the above embodiments, the connecting portion 10 has two lateral holes and the annular concave. In other possible embodiments of the present invention, one of the lateral holes may be a blind hole, and one end of the blind hole near the outer diameter surface of the connecting portion is a closed. The locking pin passes through one lateral hole and the locking hole, and then inserted into the blind hole to fix the socket tool to the driving head in order to avoid displacement and slippage. In other possible embodiments of the present invention, the socket tool may have only one or even no lateral hole. Furthermore, the socket tool may have no annular concave.

In the above embodiments, the working portion has the hexagonal hole which can be used to cover a bolt or a nut. In other possible embodiments of the present invention, the working portion can may have a hexagonal hole with a smaller size for fitting the screwdriver bit, or the working portion itself is a screwdriver bit. Furthermore, the working portion may have other different forms and uses. For example, the form and use as described in TW Pat. No. 376008, U.S. Pat. No. 6,598,849 B1, and TW Pat. No. M277571. In short, the working portion of the present invention can be made into different forms for different purposes.

It should be noted that, the friction ring is usually close to the abutting surface of the driving head. Hence, the abutting surface of the driving head can directly abut against the top surface of the socket tool when the friction ring is accommodated in the indentation. If there is a distance between the friction ring and the abutting surface, the indentation length W may need to be larger than the distance plus the thickness of the friction ring along the axis X. Therefore, the abutting surface can still directly contact the top surface when the friction ring is accommodated in the indentation.

In view of the above mention embodiments, the present invention provides a socket tool which is used to be connected to a driving head of a tool, and the socket tool is especially suitable for a driving head which is equipped with a friction ring. The friction ring can be accommodated in the indentation, so that the abutting surface of the driving head can contact the top surface directly. Therefore, a user can easily rotate the socket tool to align the square hole to the driving head. When the alignment is completed, the driving head can enter the square hole, and then a force is applied to deform the friction ring in order to reduce the outer diameter of the friction ring. Then, the driving head together with the friction ring can continue to be inserted into the socket tool. Compared with the conventional socket tool, the socket tool of the present invention is convenient, fast, and safe, for a user can rotate the socket tool to align the square hole to the driving head easily and directly. Furthermore, the alignment can be completed easily even in a dim or narrow workplace.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A socket tool used to be connected to a driving head of a tool, a front side of the driving head having an abutting surface, the driving head including a friction ring disposed in front of the abutting surface, the socket tool comprising:

a connecting portion, located on a first side of the socket tool, the connecting portion including a top surface and a polygonal hole, the top surface being recessed along an axis of the socket tool to form an indentation, the polygonal hole penetrating the indentation along the axis of the socket tool, the polygonal hole configured to accommodate the driving head; and a working portion, located on another side of the socket tool opposite to the first side of the socket tool, wherein the indentation has a side surface and a bottom surface, and the side surface is parallel to the axis of the socket tool, and wherein the abutting surface of the driving head abuts the top surface of the connecting portion when the indentation accommodates the friction ring of the driving head without the side surface of the indentation compressing the friction ring.

2. The socket tool of claim 1, wherein an indentation length along the axis of the socket tool is longer than a thickness of the friction ring along the axis of the socket tool.

3. The socket tool of claim 1, wherein viewed along the direction of the axis of the socket tool, the indentation has a periphery which is interrupted by the polygonal hole.

4. The socket tool of claim 3, wherein the periphery is substantially circular, and a periphery diameter is larger than an outer diameter of the friction ring.

5. The socket tool of claim 4, wherein the periphery is smaller than a first circumscribed circle of the polygonal hole but larger than a first inscribed circle of the polygonal hole.

6. The socket tool of claim 3, wherein the periphery is substantially polygonal, and a diameter of a second inscribed circle of the periphery is larger than the outer diameter of the friction ring.

7. The socket tool of claim 6, wherein a second circumscribed circle of the periphery is smaller than the first circumscribed circle of the polygonal hole but larger than the first inscribed circle of the polygonal hole.

8. The socket tool of claim 1, wherein the bottom surface is a plane, an arcuate surface, or a tapered surface.

9. The socket tool of claim 1, wherein the polygonal hole is a square hole, and the working portion has a hexagonal hole which extends toward the top surface along the axis of the socket tool.

10. The socket tool of claim 1, wherein the connecting portion has at least one lateral hole which is perpendicular to the axis of the socket tool, and the lateral hole communicates with the polygonal hole.

* * * * *